US005517827A

United States Patent [19]

Kiczek et al.

[11] Patent Number: 5,517,827

[45] Date of Patent: May 21, 1996

[54] DUAL FLOW TUNNEL FREEZER

[75] Inventors: Edward F. Kiczek, Long Valley, N.J.; Joseph P. Cohen, Bethlehem, Pa.; David J. Klee, Emmaus, Pa.; Robert J. Shaw, Allentown, Pa.

[73] Assignee: Air Products and Chemicals Inc., Allentown, Pa.

[21] Appl. No.: 333,172

[22] Filed: Nov. 2, 1994

[51] Int. Cl.[6] ..... F25D 25/04

[52] U.S. Cl. ..... 62/266; 62/380

[58] Field of Search ..... 62/63, 374, 380, 62/266

[56] References Cited

U.S. PATENT DOCUMENTS

| | | | |
|---|---|---|---|
| 2,533,125 | 12/1950 | Levinson et al. | 62/380 X |
| 2,974,497 | 3/1961 | Carpenter et al. | 62/380 X |
| 3,728,869 | 4/1973 | Schmidt | 62/266 |
| 4,157,650 | 6/1979 | Guibert | 62/374 |
| 4,237,695 | 12/1980 | Oberpriller et al. | 62/63 |
| 4,800,728 | 1/1989 | Klee | 62/63 |
| 5,123,261 | 6/1992 | Cope | 62/380 X |
| 5,267,449 | 12/1993 | Kiczek et al. | 62/86 |

*Primary Examiner*—William E. Tapolcai
*Attorney, Agent, or Firm*—Robert J. Wolff

[57] ABSTRACT

The present invention is a tunnel freezer which incorporates a "dual flow" design whereby the refrigerant is introduced at each end of the tunnel and withdrawn from the middle of the tunnel. A key to the present invention is that the dual flow design allows one to confine the pressure gradient for leaks between the ends of the tunnel where it will not be a concern since the item entrance and exit ports (which ports provide a ready access for leaks) are located at the ends of the tunnel.

5 Claims, 1 Drawing Sheet

DUAL FLOW TUNNEL FREEZER

FIELD OF THE INVENTION

The present invention relates to a tunnel-type freezer wherein the items to be frozen move through an elongated tunnel.

BACKGROUND OF THE INVENTION

Tunnel freezers are well known in the art. The conventional tunnel freezer comprises:

(a) an elongated tunnel having a first end and a second end;

(b) an item entrance port located at or near the first end for introducing items to be frozen into the tunnel;

(c) an item exit port located at or near the second end for withdrawing the frozen items from the tunnel;

(d) a conveyor belt for moving the items from the item entrance port, through the tunnel, and to the item exit port;

(e) a refrigerant admission port located at or near either end for introducing a refrigerant into the tunnel; and (f) a refrigerant discharge port located at or near that end of the tunnel which is opposite from the refrigerant admission port for withdrawing the refrigerant from the tunnel.

See for example U.S. Pat. No. 4,800,728 by Klee.

Refrigeration systems for producing a refrigerated atmosphere in a tunnel freezer are also well known in the art. A state of the art system is the COLDBLAST™ fresh air freezing system taught in U.S. Pat. No. 5,267,449 by Kiczek et al. Kiczek teaches an open loop refrigeration system which uses air as the refrigerant. Through a process of compression, heat exchange and expansion, ambient air is cooled to approximately −250° F. for delivery into the freezer at ambient pressure. A vacuum blower located downstream of the refrigerant discharge port provides for the withdrawal of the air refrigerant (now at approximately −100° F.) from the tunnel at a subambient pressure. Subsequent to its withdrawal, the air refrigerant is processed in order to recover its remaining refrigeration by warming it against incoming air.

There is a concern, however, when a refrigeration system such as Kiczek's which provides for (1) delivery of the refrigerant at ambient pressure and (2) withdrawal of the refrigerant at a sub-ambient pressure is coupled with the conventional tunnel freezer. The concern is that as the pressure along the length of tunnel continually drops from the ambient pressure at the refrigerant admission port to the sub-ambient pressure at the refrigerant withdrawal port, a pressure gradient is created for outside air to leak into the tunnel. The pressure gradient gradually increases along the length of the tunnel until it reaches a maximum at the refrigerant withdrawal port. This pressure gradient for leaks is generally a concern only near the location of the refrigerant withdrawal port for two reasons. First, as noted above, this location is where the pressure gradient for leaks reaches a maximum. More importantly, however, this is also the location of either the item entrance port or the item exit port and such ports provide a ready access for outside air to leak into the tunnel. In addition to introducing heat into the freezer, such outside air also introduces moisture into the freezer which quickly turns to frost.

The tunnel freezer of the present invention addresses this concern by (1) locating refrigerant admission ports at both ends of the tunnel and (2) locating the refrigerant discharge port at or near the middle of the tunnel. Such a "dual flow" design confines the pressure gradient for leaks between the ends of the tunnel where it will not be a concern since the item entrance and exit ports (which ports, as noted above, provide a ready access for leaks), remain located at the ends of the tunnel.

SUMMARY OF THE INVENTION

The present invention is a tunnel freezer which incorporates a "dual flow" design whereby the refrigerant is introduced at each end of the tunnel and withdrawn from the middle of the tunnel. A key to the present invention is that the dual flow design allows one to confine the pressure gradient for leaks between the ends of the tunnel where it will not be a concern since the item entrance and exit ports (which ports provide a ready access for leaks) are located at the ends of the tunnel.

DETAILED DESCRIPTION OF THE INVENTION

Figure 1:
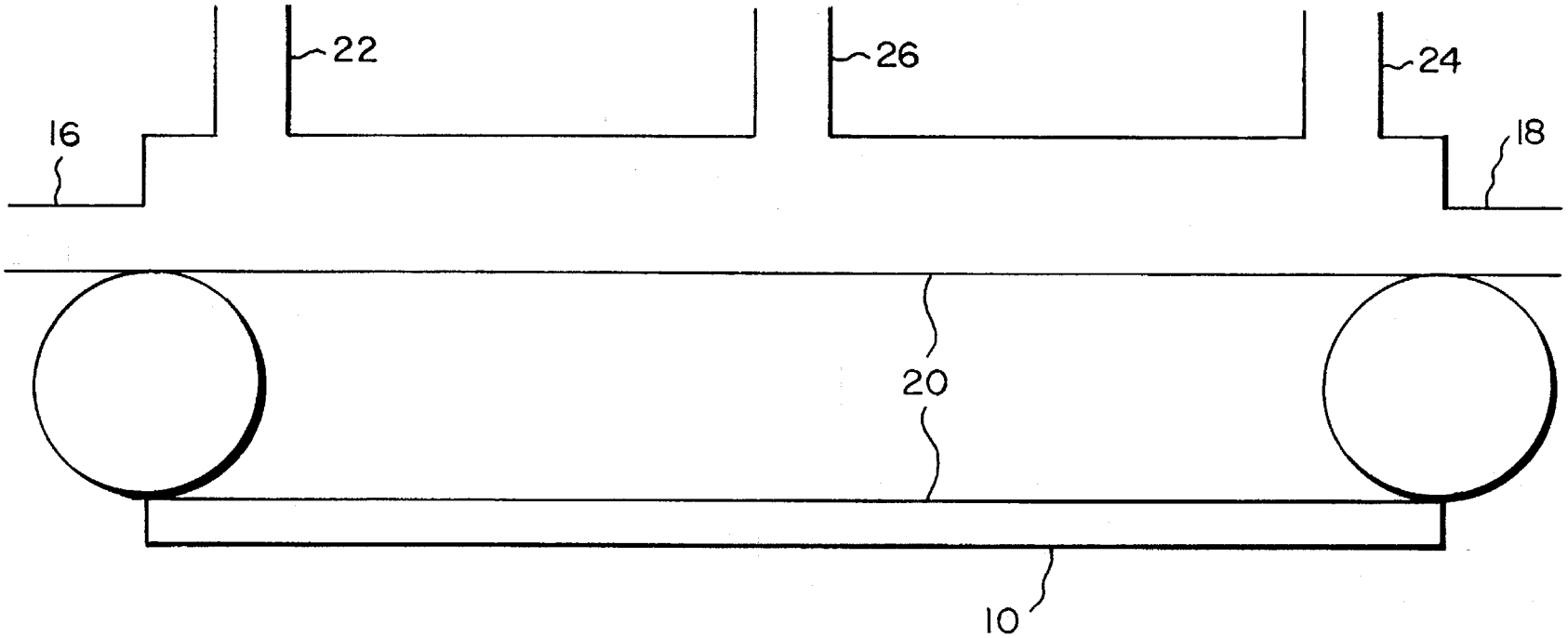
FIG. 1 is a schematic diagram of one embodiment of the present invention.

The tunnel freezer of the present invention will now be illustrated with reference to a specific embodiment thereof such as FIG. 1's embodiment. FIG. 1's tunnel freezer comprises:

(a) an elongated tunnel 10 having a first end and a second end;

(b) an item entrance port 16 located at or near the first end for introducing items to be frozen into the tunnel;

(c) an item exit port 18 located at or near the second end for withdrawing the frozen items from the tunnel;

(d) a conveyor belt 20 for moving the items from the item entrance port, through the tunnel, and to the item exit port;

(e) a first refrigerant admission port 22 located at or near the first end for introducing a refrigerant into the tunnel;

(f) a second refrigerant admission port 24 located at or near the second end for introducing a second portion of the refrigerant into the tunnel; and (g) a refrigerant discharge port 26 located at or near the middle of the tunnel for withdrawing the refrigerant from the tunnel.

As can be seen in FIG. 1, the item entrance and exit ports and the refrigerant admission and discharge ports are arranged such that:

(a) the item entrance port introduces the items into the tunnel at an angle substantially parallel to the longitudinal axis of the tunnel;

(b) the item exit port withdraws the items from the tunnel at an angle substantially parallel to the longitudinal axis of the tunnel;

(c) the first and second refrigerant admission ports introduce the refrigerant into the tunnel at an angle substantially perpendicular to the longitudinal axis of the tunnel; and (d) the refrigerant discharge port withdraws the refrigerant from the tunnel at an angle substantially perpendicular to the longitudinal axis of the tunnel; and (e) subsequent to its introduction and prior to its withdrawal, the refrigerant flows through the tunnel at an angle substantially parallel to the longitudinal axis of the tunnel.

This arrangement of the item entrance and exit ports and the refrigerant admission and discharge ports is preferred in that it provides three distinct freezing sections as follows.

(1) The perpendicular flow of the entering refrigerant relative to the flow of the entering items to be frozen provides for a first concentrated high velocity freezing section which is used to provide high velocity refrigerant immediately onto the product at close proximity to crust freeze the product as it enters. This freeze reduces dehydration by providing a diffusion barrier to prevent water from escaping. The velocity is generally imparted to the product via a series of orifices as close to the product as possible without creating damage. Velocity can be imparted to the product from the top only, or balanced top and bottom.

(2) The parallel flow of the refrigerant relative to the flow of the items to be frozen which occurs between the ends of the tunnel provides for a convective heat transfer section which is used to continue the freezing process. Note also that baffles and recirculating fans can be included in this parallel flow section as are well known in the art to improve the convective heat transfer in this section.

(3) The perpendicular flow of the entering refrigerant relative to the flow of the exiting items to be frozen provides for a second concentrated high velocity freezing section.

As discussed in the Background section, in order to take advantage of the present invention's dual flow design in eliminating outside leaks, the present invention should be coupled to a refrigeration system which provides for (1) delivery of the refrigerant at ambient pressure and (2) withdrawal of the refrigerant at a sub-ambient pressure. One such refrigeration system is the COLDBLAST™ fresh air freezing system taught in U.S. Pat. No. 5,267,449 by Kiczek et al. Kiczek teaches an open loop refrigeration system which uses air as the refrigerant. Through a process of compression, heat exchange and expansion, ambient air is cooled to approximately −250° F. for delivery into the freezer at ambient pressure. A vacuum blower located downstream of the refrigerant discharge port provides for the withdrawal of the air refrigerant (now at approximately −100° F.) from the tunnel at a sub-ambient pressure. Subsequent to its withdrawal, the air refrigerant is processed in order to recover its remaining refrigeration by warming it against incoming air. In addition to meeting the delivery pressure and withdrawal pressure criteria, the present invention's tunnel freezer is especially suited to be coupled to Kiczek's refrigeration system because the elimination of leaks enhances the amount of refrigeration that can be recovered in Kiczek's refrigeration recovery step. Furthermore, since pressure is available in Kiczek due to compression/turbo expansion, little efficiency debit is taken when using this pressure to generate high velocity/high convective heat transfer. The availability of pressure in Kiczek also eliminates the need to install internal recirculating fans in the tunnel freezer.

It should be noted, however, that notwithstanding the suitability of the present invention to Kiczek's refrigeration system, the present invention is not limited to a particular refrigeration system or refrigerant. For example, refrigeration systems that evaporate liquid nitrogen or liquid carbon dioxide as the refrigerant and subsequently warm the evaporated refrigerant can also be coupled to the tunnel freezer of the present invention. In order to provide sufficient velocity along the length of the tunnel for effective heat transfer in such a liquid evaporation system, a recirculation system can be employed whereby a portion of the refrigerant withdrawn through the refrigerant discharge port is recirculated to each refrigerant admission port by respective recirculation fans. The present invention has been described with reference to specific embodiments thereof. These embodiments should not be seen as a limitation of the scope of the present invention; the scope of such being ascertained by the following claims.

We claim:

1. A dual flow tunnel freezer comprising:

(a) an elongated tunnel having a first end and a second end;

(b) an item entrance port located at or near the first end for introducing items to be frozen into the tunnel;

(c) an item exit port located at or near the second end for withdrawing the frozen items from the tunnel;

(d) a conveyor belt for moving the items from the item entrance port, through the tunnel, and to the item exit port;

(e) a first refrigerant admission port located at or near the first end for introducing a refrigerant into the tunnel;

(f) a second refrigerant admission port located at or near the second end for introducing a second portion of the refrigerant into the tunnel; and (g) a refrigerant discharge port located at or near the middle of the tunnel for withdrawing the refrigerant from the tunnel.

2. The tunnel freezer of claim 1 wherein:

(a) the item entrance port introduces the items into the tunnel at an angle substantially parallel to the longitudinal axis of the tunnel;

(b) the item exit port withdraws the items from the tunnel at an angle substantially parallel to the longitudinal axis of the tunnel;

(c) the first and second refrigerant admission ports introduce the refrigerant into the tunnel at an angle substantially perpendicular to the longitudinal axis of the tunnel;

(d) the refrigerant discharge port withdraws the refrigerant from the tunnel at an angle substantially perpendicular to the longitudinal axis of the tunnel; and (e) subsequent to its introduction and prior to its withdrawal, the refrigerant flows through the tunnel at an angle substantially parallel to the longitudinal axis of the tunnel.

3. The tunnel freezer of claim 2 wherein said tunnel freezer is coupled to a refrigeration system which:

(a) provides for the delivery of the refrigerant into the refrigerant admission ports at ambient pressure; and (b) provides for the withdrawal of the refrigerant from the refrigerant discharge port at a sub-ambient pressure.

4. The tunnel freezer of claim 2 wherein said tunnel freezer is coupled to a refrigeration system which:

(a) provides for the delivery of an air refrigerant into the refrigerant admission ports at a temperature of approximately −250° F. and at ambient pressure;

(b) provides for the withdrawal of the air refrigerant from the refrigerant discharge port at a temperature of approximately −100° F. and at a sub-ambient pressure via a vacuum blower located downstream of the refrigerant discharge port; and (c) subsequent to its withdrawal, the air refrigerant is processed in order to recover its refrigeration.

5. The tunnel freezer of claim 2 wherein said tunnel freezer is coupled to a liquid evaporation refrigeration system which:

(a) provides for the delivery of a liquid refrigerant into the refrigerant admission ports;

(b) provides for the withdrawal of the refrigerant in its evaporated state; and (c) employs a recirculation system whereby a portion of the refrigerant withdrawn through the refrigerant discharge port is recirculated to each refrigerant admission port by respective recirculation fans.

* * * * *